US005621156A

United States Patent [19]

Thompson

[11] Patent Number: 5,621,156

[45] Date of Patent: Apr. 15, 1997

[54] HYPERGOLIC FUEL FORMULATION: DIETHYLETHANOLAMINE, TRIETHYLAMINE, AND CARBON

[75] Inventor: Darren M. Thompson, Madison, Ala.

[73] Assignee: The United States of America as represented by the Secretary of the Army, Washington, D.C.

[21] Appl. No.: 712,524

[22] Filed: Sep. 11, 1996

[51] Int. Cl.[6] ..... C10L 7/02; C10L 7/04

[52] U.S. Cl. ..... 44/266; 44/265; 44/280; 60/211

[58] Field of Search ..... 44/265, 266, 280; 60/211

[56] References Cited

U.S. PATENT DOCUMENTS

| | | | |
|---|---|---|---|
| 4,081,252 | 3/1978 | Osborg | 44/53 |
| 4,316,359 | 2/1982 | Sayles | 60/212 |
| 4,872,885 | 10/1989 | Tsubakimoto et al. | 44/51 |

*Primary Examiner*—Charles T. Jordan

*Assistant Examiner*—John R. Hardee

*Attorney, Agent, or Firm*—Hugh P. Nicholson; Freddie M. Bush

[57] ABSTRACT

A hypergolic fuel formulation which is consistently hypergolic with inhibited red fuming nitric acid is comprised of diethylethanolamine from about 44–72 weight percent, triethylamine from about 11–18 weight percent, and carbon from about 45–10 weight percent The formulation can be gelled with: silica, clays, carbons, or swellable polymers. The gellants can be combined with chemical agents that stabilize the gel under the standard 30 minute, 500 g centrifuge stability test. A preferred combination comprising diethylethanolamine in an amount of about 44 weight percent, triethylamine in an amount of about 11 weight percent, and carbon in an amount of about 45 weight percent when tested at an oxidizer/fuel ratio of about 4.25 reveals theoretical performance values of specific impulse (ISP) of about 250 at a chamber pressure of 1000 Psi and a density specific impulse (D* ISP) of about 350. The performance values of ISP and D*ISP when the specified combination is tested at the same oxidizer/fuel ratio and at a chamber pressure of 2000 Psi reveals are about 265 and about 372, respectively.

2 Claims, 2 Drawing Sheets

HYPERGOLIC FUEL FORMULATION: DIETHYLETHANOLAMINE, TRIETHYLAMINE, AND CARBON

DEDICATORY CLAUSE

The invention described herein may be manufactured, used, and licensed by or for the Government for governmental purposes without the payment to me of any royalties thereon.

BACKGROUND OF THE INVENTION

Many liquid and all gel propulsion systems are based on hydrazine or its derivatives. These materials are very energetic and reactive; however, they are characterized as being toxic. Thus, a successful competitive fuel that is less toxic should be hypergolic with the oxidizer inhibited red fuming nitric acid (IRFNA), type III B) and should be as energetic as the hydrazine based fuels. An alternative fuel disclosed hereinbelow is less toxic and meets the requirements of being hypergolic with IRFNA.

Triethylamine has been identified in the propulsion literature as being hypergolic with IRFNA but it has an unacceptable delay in igniting. Diethylethanolamine is very reactive with IRFNA but it is not hypergolic.

An object of this invention is to provide an alternative fuel which has acceptable ignition times, hypergolic with IRFNA, less toxic than hydrazine based fuel, and be as energetic as the hydrazine based fuels.

SUMMARY OF THE INVENTION

The alternative fuel which is a competitive fuel with hydrazine based fuels is comprised of a combination of diethylethanolamine, triethylamine, and carbon. The ratios of the basic ingredients can vary according to the requirements of the specific application, but will vary within these ranges:

diethylethanolamine 44–72 weight percent
triethylamine 11–18 weight percent
carbon 45–10 weight percent.

The combination is hypergolic consistently with IRFNA. The formulation can be gelled with: silica, clays, carbons, or swellable polymers. The gellants can be combined with chemical agents that stabilize the gel under the standard 30 minute, 500 g centrifuge stability test.

DESCRIPTION OF THE PREFERRED EMBODIMENT(s)

The combinations of diethylethanolamine from about 44–72 weight percent, triethylamine from about 11–18 weight percent, and carbon from about 45–10 weight percent are hypergolic consistently. It is the combination of diethylethanolamine and triethylamine which renders acceptable ignition times. Although triethylamine has been identified in the propulsion literature as being hypergolic with IRFNA the delay time for ignition is unacceptable. Diethylethanolamine, although very reactive with IRFNA, is not hypergolic with IRFNA; however, it is unexpected that the mixture of triethylamine and diethylethanolamine proved to be hypergolic consistently.

EXAMPLE 1

| INGREDIENT | WEIGHT PERCENT |
|---|---|
| Diethylethanolamine | 44 |
| Triethylamine | 11 |
| Carbon | 45 |

Figure 1:
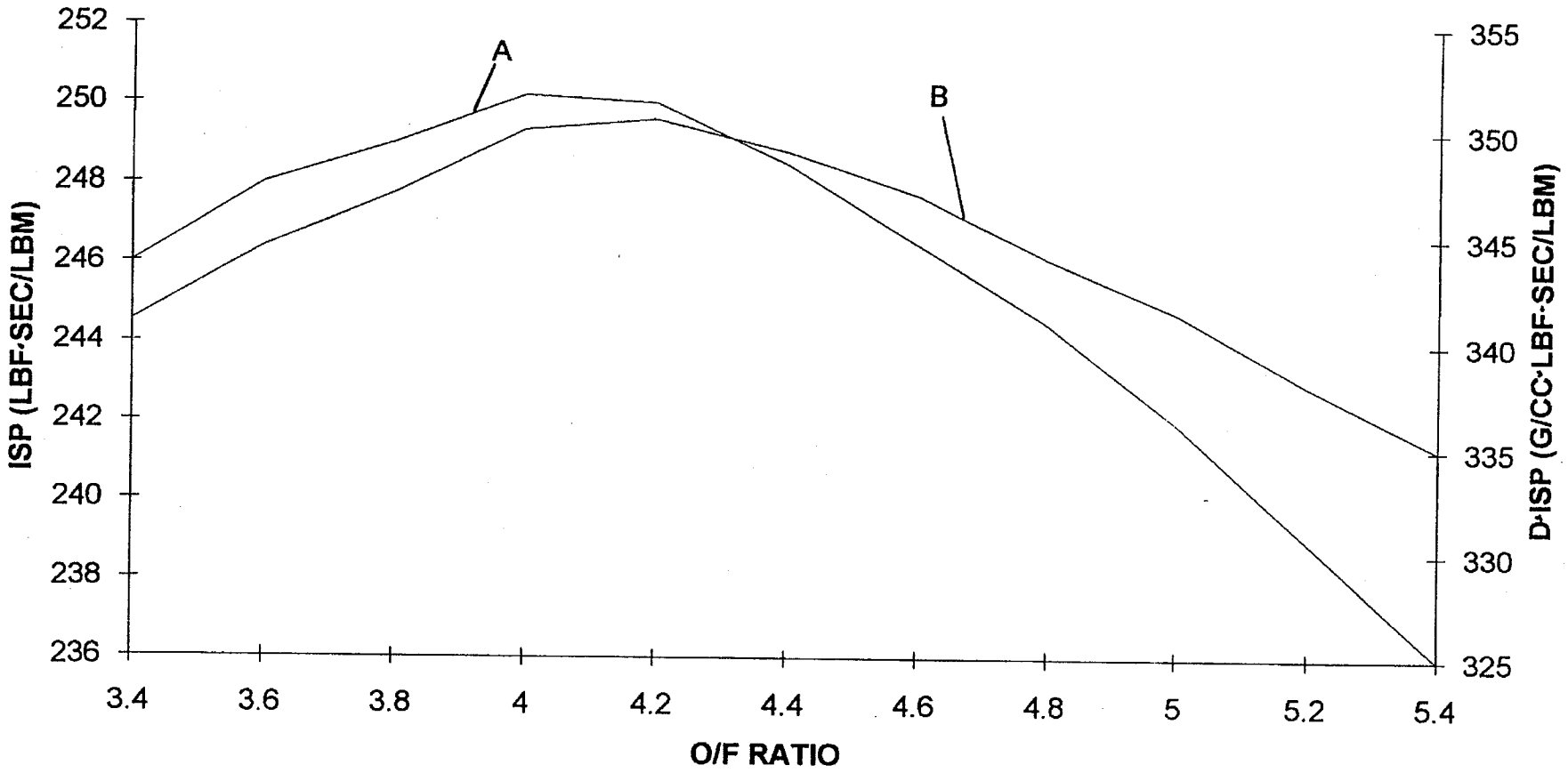
FIG. 1 depicts ISP vs D * ISP at 1000 PSI for oxidizer/fuel ratios between 3.0 and 5.5.
Figure 2:
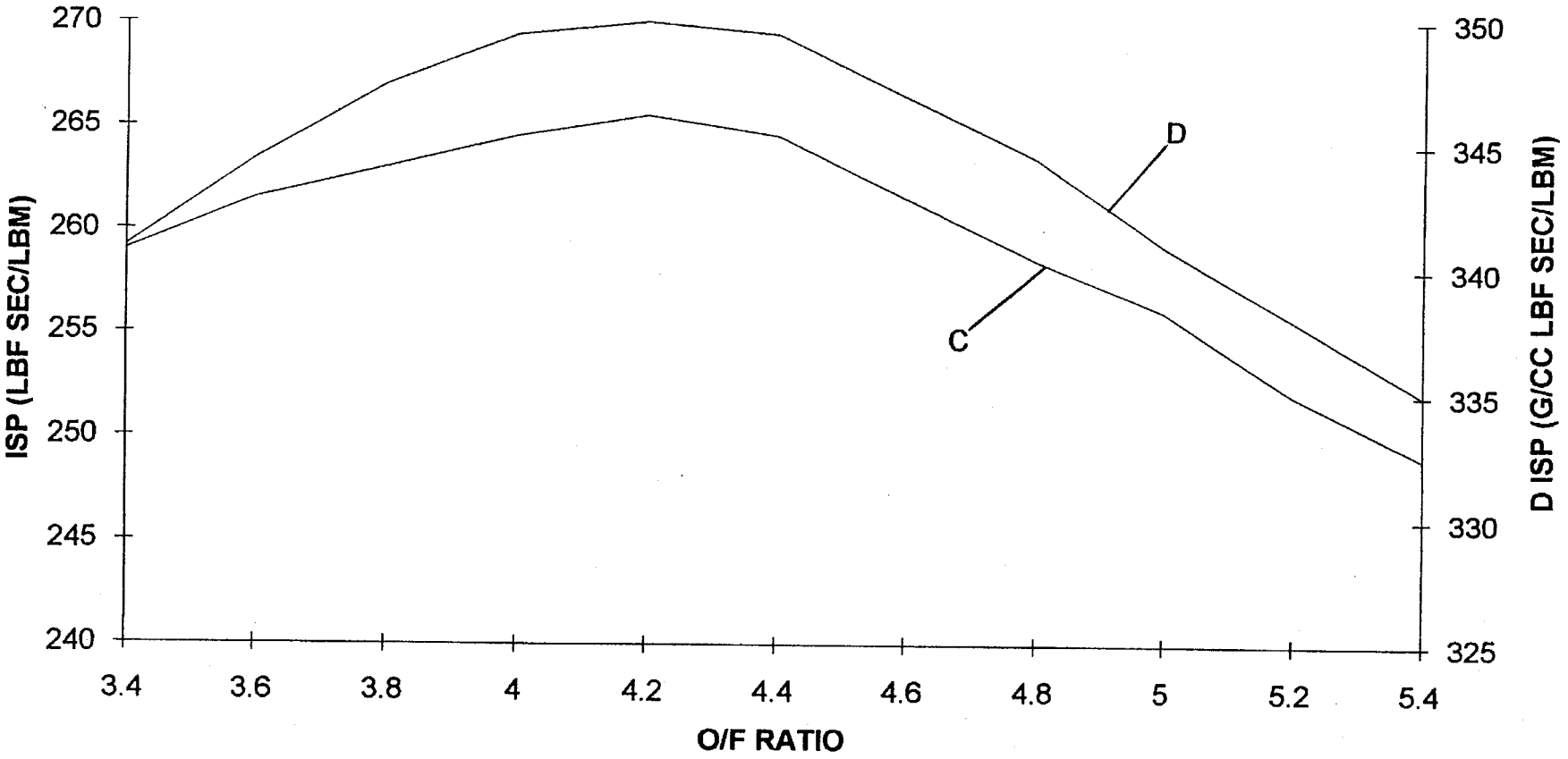
FIG. 2 depicts ISP vs D * ISP at 2000 PSI for oxidizer/fuel ratios between 3.0 and 5.5.

In further reference to the FIG. 1 and FIG. 2 of the Drawing, the theoretical performance values of the formulation of Example 1 are shown for specific impulse (ISP) (lbf*sec/lbm) and density specific impulse (D*ISP) (g/cc*lbf*sec/lbm) at combustion chamber pressures of 1000 Psi. and 2000 Psi. respectively. Curves A and B of FIG. 1 depict the variation of the mass specific impulse (Isp) and volume specific impulse (D* Isp) as a function of oxidizer to fuel (O/F) ratio. Curves C and D of FIG. 2 depict the same type information at 2000 PSI. The mass specific impulse is a figure of merit that relates to the mass requirements of a propulsion system design, whereas the volume specific impulse relates to the volumetric requirements. The acceptable terminology in the propulsion art recognizes that D*Isp means density times specific impulse and similarly, the * between the terms means times as defined hereinabove.

The formulations set forth hereinabove can be gelled to form stable gels to withstand high g forces such as encountered in rocket engines or motors. Many state of the art gelling systems which employ colloidal silica, colloidal clays, swellable polymer of hydroxypropyl cellulose, and surfactant dispersing agents can be employed. The formulation of Example 1 was gelled with a bentonite clay which is also defined as, a colloidal clay and a powder ingredient for gel forming and viscous suspensions. A bentonite product containing a colloidal hydrate aluminum silicate is a modified form of bentonite. Many special bentonite clays are listed in the technical literature and are available commercially. A preferred commercially available bentonite clay for use in gelling composition of hypergolic fuel gels is Bentone SD-1, available under the designated Trademark of N-L Industries, New York, N.Y. The formulation of Example 1 employed Bentone SD-1 as the gelling agent. This formulation and other formulations within the ranges of ingredients set forth hereinabove were gelled with an additive of 3% Bentone SD-1 and 1% propylene carbonate which yielded a stabilized gel tested under the standard 30 minute, 500 g centrifuge stability test. The testing of the hypergolic performance of the formulations can be achieved without gelling.

The structural formulae of the two amine compounds are set forth below to impart a better understanding of the reaction mechanism which is believed to take place in the hypergolic reaction with IRFNA wherein a high exothermic reaction takes place in the production of the resulting salt products.

Triethylamine has the following structural formula:

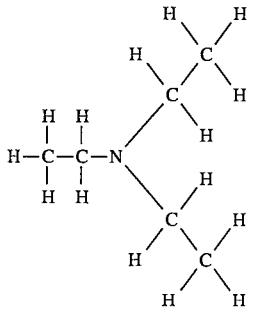

Diethylethanolamine has the following structural formula:

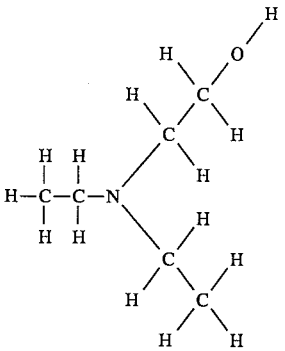

I claim:

1. A hypergolic fuel formulation which is consistently hypergolic with inhibited red fuming nitric acid, said hypergolic fuel formulation comprising:

(i) diethylethanolamine in an amount from about 44 to about 72 weight percent;

(ii) triethylamine in an amount from about 11 to about 18 weight percent; and, (iii) carbon in an amount from about 45 to about 10 weight percent.

2. The hypergolic fuel formulation as defined in claim 1 in the form of a fuel gel wherein said diethylethanolamine is present in an amount of about 44 weight percent; said triethylamine is present in an amount of about 11 weight percent; and said carbon is present in an amount of about 45 weight percent, said fuel gel containing an effective amount of gellants selected from the group consisting of finely divided silica, clays, carbon black, and a swellable polymer of hydroxypropyl cellulose, said gellants additionally comprising a chemical stabilizing agent of dimethyl urea of about 0.1 weight percent for stabilizing said gel under the standard 30 minute, 500 g centrifuge stability test.

* * * * *